United States Patent [19]

Manservisi

[11] Patent Number: 4,617,783

[45] Date of Patent: Oct. 21, 1986

[54] COMPRESSION DRUM FOR CIGARETTES

[75] Inventor: Renato Manservisi, Bologna, Italy

[73] Assignee: SASIB S.p.A., Bologna, Italy

[21] Appl. No.: 754,451

[22] Filed: Jul. 11, 1985

[30] Foreign Application Priority Data

Jul. 18, 1984 [IT] Italy ..... 12566 A/84

[51] Int. Cl.[4] ..... B65B 13/20

[52] U.S. Cl. ..... 53/529; 100/177

[58] Field of Search ..... 53/149, 150, 151, 444, 53/529, 574, 575; 100/177, 178, 223, 232

[56] References Cited

U.S. PATENT DOCUMENTS

| | | | |
|---|---|---|---|
| 2,209,110 | 7/1940 | Chalmers et al. | 53/529 |
| 3,479,787 | 11/1969 | Bardenhagen et al. | 53/529 X |
| 3,583,130 | 6/1971 | Gianese | 53/529 |
| 4,341,056 | 7/1982 | Leanna et al. | 53/529 |

*Primary Examiner*—E. R. Kazenske
*Assistant Examiner*—Michael D. Folkerts
*Attorney, Agent, or Firm*—Spencer & Frank

[57] ABSTRACT

A compression drum (1) for orderly groups of cigarettes (G) in automatic cigarette-packing machines has one or more compression pockets (2). Each compression pocket has a substantially rectangular cross-section and includes at least partly, movable sidewalls (3, 3', 4, 4') permitting the cross-section of a pocket to be varied between a maximum expansion condition, wherein an orderly group of cigarettes (G) to be packed is introduced thereinto, and a maximum compression condition, wherein the group of cigarettes (G) received in the pocket (2) is compressed. At least two adjacent sidewalls (3, 4 and/or 3', 4') of each compression pocket (2), one of which (3, 3') corresponds to a longer side and the other to a shorter side of the rectangular cross-section, are separate from each other and from the other sidewalls of the pocket and are movable independently from each other and each one with respect to the opposite respective sidewall (3', 4' and/or 3,4) so as to achieve a mutual movement of the walls of each pair of opposite sidewalls of a compression pocket (2) toward each other and away from each other.

8 Claims, 3 Drawing Figures

COMPRESSION DRUM FOR CIGARETTES

BACKGROUND OF THE INVENTION

This invention relates to compression drums for orderly groups of cigarettes in automatic cigarette-packing machines, said compression drums comprising one or more tubular compression pockets each having a substantially rectangular cross-section and each including, at least partly, movable sidewalls permitting the cross-section of a pocket to be varied between a maximum expansion condition, wherein an orderly group of cigarettes to be packed is introduced thereinto, and a maximum compression condition, wherein the group of cigarettes received in the pocket is compressed.

In the heretofore known compression drums of the type specified above, each compression pocket comprises two opposite L-shaped sections oppositely arranged to form the rectangular cross-section of the pocket and which are movable with respect to each other in a direction which is oblique to the sides of said cross-section, so as to mutually move toward each other and away from each other to achieve the maximum compression condition and the maximum expansion condition, respectively, of the pocket. In these known pockets, each sidewall corresponding to a longer side of the rectangular cross-section of a pocket is integral with a sidewall corresponding to a shorter side of the rectangular cross-section of the pocket. As a result, the mutual displacement of the opposite sidewalls, corresponding to the longer sides of the cross-section of the pocket, and the mutual displacement of the opposite sidewalls, corresponding to the shorter sides of said cross-section, depend both upon each other and upon the angle of the direction of the relative movement of the two L-shaped sections with respect to one of the sides, e.g. the longer side. This dependence is a serious inconvenience, particularly when the cross-section of packages is to be changed. In fact, a change in the cross-section of a package of cigarettes may require a change in the angle of the direction of the relative movement of the two complementary L-shaped sections. On the other side, when only one of the L-shaped sections is movable while the other keeps still, the center of the cross-section of the compression pocket in the maximum expansion condition is not coincident with the center of said cross-section in the maximum compression condition of the pocket. As a result, a compression drum adapted to permit the variation of the angle of direction of the relative movement between the two L-shaped sections requires the replacement of several parts and a particularly complicate setup.

SUMMARY OF THE INVENTION

This invention aims to avoid said drawbacks of the heretofore known devices, and it is substantially characterized in that at least two adjacent sidewalls of each compression pocket, one of which corresponds to a longer side and the other to a shorter side of the rectangular cross-section of a pocket, are separate from each other and from the other sidewalls of said pocket and are movable independently from each other, each one with respect to the respective opposite sidewall, so as to achieve a mutual movement of the walls of said pair of opposite sidewalls of a pocket toward and away from each other. By this arrangement, the mutual displacement of the sidewalls corresponding to the longer sides of the rectangular cross-section of a pocket toward and away from each other while changing from the maximum expansion condition to the maximum compression condition, and vice versa, is independent from the mutual movement of the two other sidewalls corresponding to the shorter sides of the cross-section of said pocket toward and away from each other.

According to the invention, two adjacent sidewalls of a tubular compression pocket, one of which corresponds to a longer side and the other to a shorter side of the cross-section of said pocket, may be kept stationary in the compression drum, while the two other walls may be movably mounted in the compression drum independently from each other and substantially perpendicularly to the respective opposite stationary sidewalls.

Preferably, however, to achieve the mutual movement of two opposite walls of the tubular compression pocket toward and away from each other, both walls of each pair of opposite sidewalls are mounted movably in a compression drum.

In order to move the movable walls of each tubular compression pocket of the compression drum according to the invention, any suitable actuating means may be used, preferably an actuating device having the characteristics set forth in the dependent claims.

BRIEF DESCRIPTION OF THE DRAWINGS

An embodiment of a compression drum according to the invention is shown diagrammatically as a non-limitating example in the accompanying drawings, wherein.

DESCRIPTION OF THE PREFERRED EMBODIMENT

Figure 1:
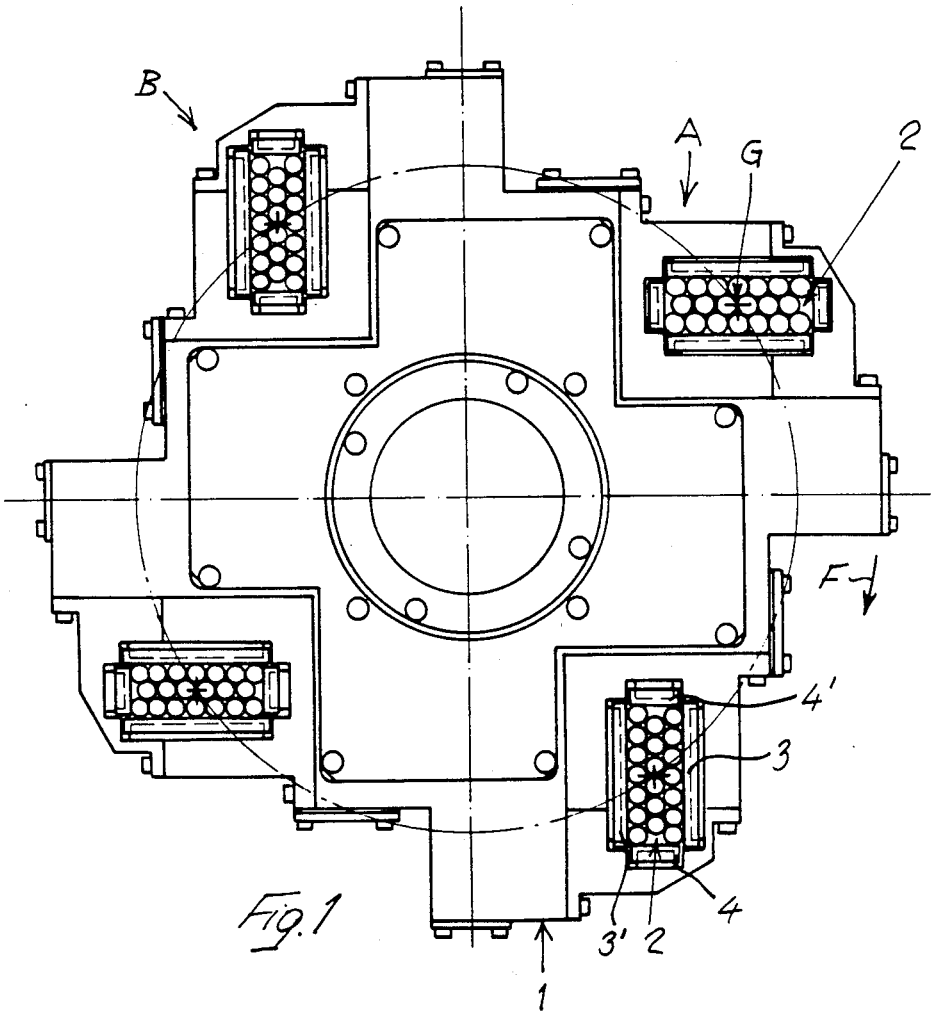
FIG. 1 is an axial end view of a compression drum according to the invention.

In the Figures, 1 indicates the compression drum of an automatic cigarette-packing machine. Such a drum comprises, in a known manner, a ring of four tubular compression pockets 2 angularly equi-spaced from each other and arranged with the longitudinal axis of their interior parallel to the rotation axis of the drum 1. The compression drum 1 rotates intermittently, for example, in the direction of the arrow F, so as to make each pocket 2 stop, first at a loading station A whereat an orderly group of cigarettes G intended to for a package is axially introduced into a compression pocket 2, and then at a discharge station B whereat said group of cigarettes is axially ejected from the compression pocket 2 and is introduced into a tubular arbor whereon a single or a double wrapper for a package has been formed previously. While moving from the station A to the station B, the group of cigarettes G is compressed transversely to the cigarettes. For this purpose, the cross-section of the compression pocket 2 is reduced, said cross-section being in the maximum expansion condition at the station A, and a maximum compression condition at a station or position preceding the station B. At the station B, the cross-section of the pocket 2 is again expanded slightly to facilitate the injection of the compressed group of cigarettes G.

Each compression pocket 2 has a rectangular cross-section and comprises two wider sidewalls 3 and 3', which are opposite and parallel to each other, and two narrower sidewalls 4 and 4', also opposite and parallel to each other.

The sidewalls 3,3',4 and 4' are separate from each other and are movable independently from each other with respect to the compression drum 1 in order to change the cross-section of the respective compression pocket.

In the illustrated embodiment, each sidewall 3,3', 4,4' of each compression pocket 2 comprises—on the side opposite to the pocket-interior-peripheral flanges 103, 103', 104, 104' and a central rib 203, 203', 204, 204', by means of which it is slidably guided, perpendicularly to its plane, in corresponding grooves in the body of the compression drum 1.

Figure 2:
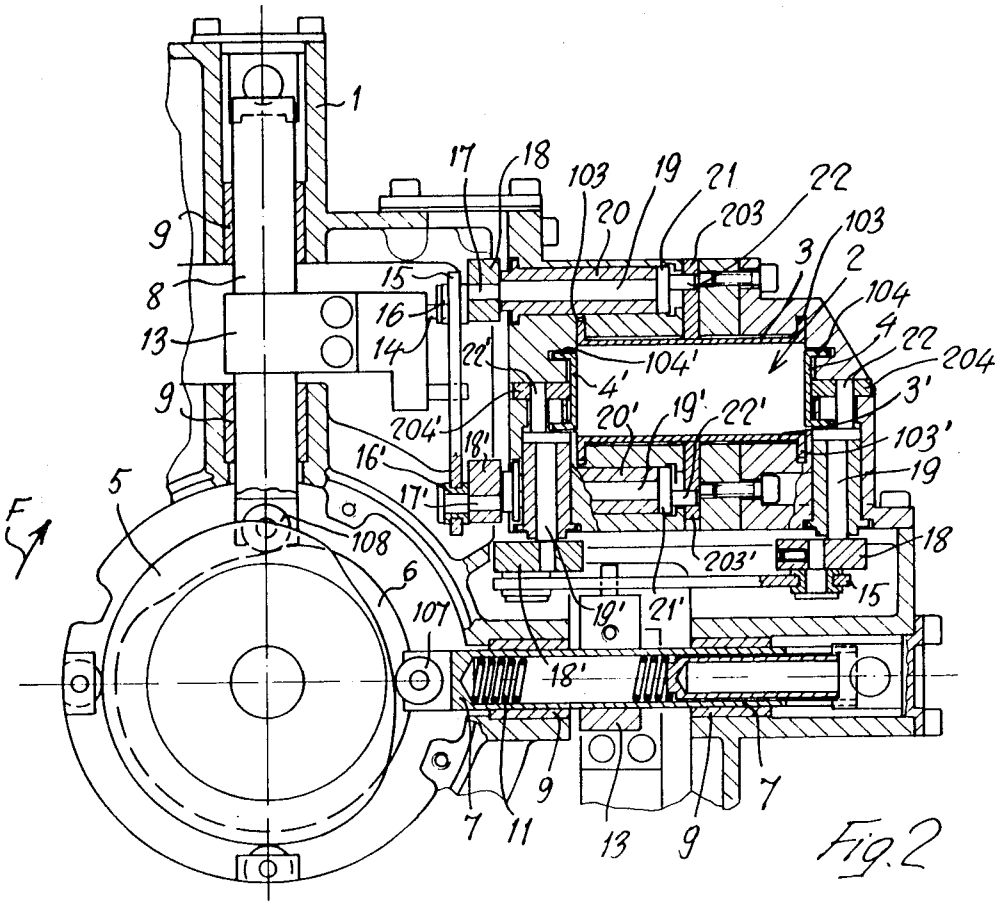
FIG. 2 is a cross section of the actuating device for the movable walls of one of the compression pockets of the compression drum.

The device for moving the two wider sidewalls 3, 3' and the two narrower sidewalls 4, 4' towards each other comprises two fixed cams 5 and 6 which are co-axial with the compression drum 1. Each compression pocket 2 has associated therewith two cam followers 7 and 8 which are radially slidably but not rotatably mounted within the body of the drum 1 in suitable guide sleeves 9 and which co-operate through end rollers 107, 108 one (7) with the fixed cam (5) and the other (8) with the cam 6. The cam followers 7 and 8 are urged towards the respective cams 5 and 6 and are kept in contact therewith by means of associated springs 11, as shown in FIG. 2 in connection with the cam follower 7. The cam follower 7 controls the displacement of the narrower sidewalls 4, 4' of the associated pocket 2 and is located downstream thereof with respect to the direction of rotation F of the drum 1, whereas the cam follower 8 controls the displacement of the wider sidewalls 3, 3' of the associated pocket 2 and is located upstream of said pocket with respect to direction of rotation F of said drum 1, as clearly viewed in FIG. 2. The two cam followers 7 and 8 are substantially perpendicular to each other and to the associated sidewalls 4, 4' and 3, 3' of the respective compression pocket 2.

Figure 3:
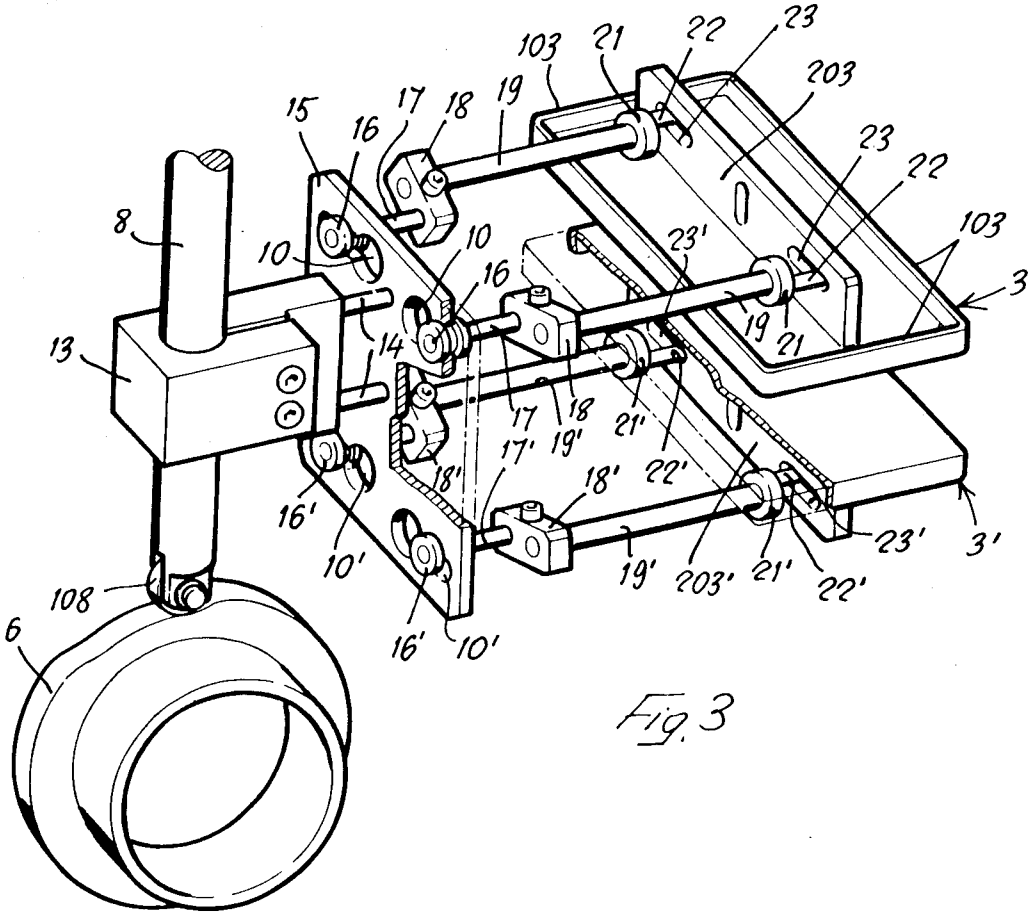
FIG. 3 is a perspective view of a portion of the actuating device for mutually moving two opposite walls of a compression pocket of the compression drum.

The displacing devices, by means of which the cam followers 7 and 8 control the approaching and moving apart movements of the associated sidewalls 4, 4' and 3, 3' of the respective pocket 2, are identical for the two pairs of walls 4, 4' and 3, 3', i.e. for each cam follower 7 and 8. Therefore, we will describe hereinafter, with particular reference to FIG. 3, only the displacing device associated with the cam follower 8 and arranged between said cam follower 8 and the pair of wider sidewalls 3, 3'.

The cam follower 8 has fixed thereto a clamp 13 carrying two studs 14 engaged in a plate 15 which is substantially perpendicular to the two walls 3, 3' and movable in the plane thereof parallelly to the cam follower 8 in the body of the drum 1. The plate 15 mounts, for each wall 3, 3', two bushes 16, 16' which are slidable within corresponding slots 10 and 10' of said plate 15. Rotatably journaled in each of said bushes 16, 16' is a spindle 17, 17' which is connected by means of a crank 18, 18' to a corresponding excentric driving shaft 19, 19' which is rotatably but not axially slidably mounted in the body of the drum 1, e.g. in corresponding sleeves 20, 20' (FIG. 2). The driving shafts 19, 19', at the ends thereof remote from the cranks 18, 18', are provided each with a flange 21, 21' and an eccentric pin 22, 22'. The eccentric pins 22 of the two shafts 19 are engaged in slots 23 formed in the intermediate rear rib 203 of the wider sidewall 3 of the pocket 2, while the excentric pins 22' of the two other shafts 19' are engaged in similar slots 23' formed in the intermediate rear rib 203' of the other wider sidewall 3' of the pocket. It is now apparent that when the cam follower 8 is moved by the action of the respective cam 6, it displaces the movable plate 15 thus causing the rotation of the actuating shafts 19, 19' through the cranks constituted by the arms or cheeks 18, 18' and spindles 17, 17', while the bushes 16, 16' for these spindles move in the respective slots 10, 10' of the plate 15. The rotation of the actuating shafts 19, 19' causes, through the eccentric pins 22, 22' of these shafts, the displacement of the associated walls 3, 3' of the pocket 2. The arrangement is such that when the cam 6 causes the radial outward displacement of the cam follower 8, i.e. upwards in the FIGS. 2 and 3, the wider sidewalls 3, 3' of the pocket 2 will move both toward each other with respect to the body of the compression drum 1, whereas when the cam follower 8 moves radially inwards, i.e. downwards in the FIGS. 2 and 3, by the action of the respective spring 11, the wider sidewalls 3, 3' of the pocket 2 will move away from each other, or vice versa.

The device for displacing the two other sidewalls 4, 4' of the compression pocket by means of the cam follower 7 has the same construction and operation of the one described above and can be viewed partly in FIG. 2, in which figure the displacing device associated with the cam follower 7 and the narrower sidewalls 4, 4' of the pocket 2 have the same reference numerals that have been used for said displacing device associated with the cam follower 8 and wider sidewalls 3, 3' of the pocket.

Preferably, the cams 5 and 6 are contoured and are angularly adjusted so as to cause the mutual approaching, first of the wider walls 3, 3', and then of the narrower walls 4, 4'; however, a reversed sequence of the mutual approaching of the walls 3, 3' and 4, 4' or a simultaneous mutual approaching of all the walls 3,3', 4, 4' is possible.

In the illustrated embodiment, all the sidewalls 3, 3', 4, 4' of each compression pocket have planar and smooth inner surfaces. However, the narrower sidewalls 4, 4' may be provided, on the inner surface thereof, with a longitudinal rib in registry with the intermediate row of cigarettes, when the number of cigarettes in said intermediate row is smaller than the number of cigarettes in the outer rows.

What I claim is:

1. A rotatable compression drum for orderly groups of cigarettes in automatic cigarette-packing machines, comprising:

a compression pocket having a substantially rectangular cross-section and including a pair of longer sidewalls that are disposed opposite each other and that correspond to the longer sides of the rectangular cross-section of the pocket and a pair of shorter sidewalls that are disposed opposite each other and that correspond to the shorter sides of the rectangular cross-section of the pocket, at least one longer sidewall and at least one shorter sidewall being separate from each other and the remaining sidewalls and being independently movable toward and away from the respective opposite sidewalls; and actuating means operatively connected to said at least one longer sidewall and at least one shorter sidewall for permitting the cross-section of the pocket to be modified between a maximum expansion condition, wherein an orderly group of cigarettes to be packed is introduced into the pocket, and a maximum compression condition, wherein the group of cigarettes received in the pocket is compressed, said actuating means causing one pair of opposite sidewalls to approach each other and thereafter causing the other pair of opposite sidewalls to approach each other, wherein for each pair of opposite sidewalls said actuating means includes a respective cam follower that is movably mounted in the drum and that is operatively connected to at least one of the respective opposite sidewalls, and a respective fixed cam that is co-axial with the drum and that cooperates with the respective cam follower, wherein one cam follower is disposed upstream of the pocket and the other cam follower is disposed downstream of the pocket with respect to the direction of rotation of the drum, and wherein the cam followers are slidably but not rotatably mounted in the drum substantially radially thereto and are perpendicular to each other and the respective pair of opposite sidewalls.

2. A compression drum according to claim 1, wherein a longer sidewall and a shorter sidewall are kept stationary in the compression drum.

3. A compression drum according to claim 1, wherein both longer sidewalls and both shorter sidewalls are movably mounted in the compression drum.

4. A compression drum for orderly groups of cigarettes in automatic cigarette-packaging machines, comprising:

a compression pocket having a substantially rectangular cross-section and including a pair of longer sidewalls that are disposed opposite each other and that correspond to the longer sides of the rectangular cross-section of the pocket and a pair of shorter sidewalls that are disposed opposite each other and that correspond to the shorter sides of the rectangular cross-section of the pocket, at least one longer sidewall and at least one shorter sidewall being separate from each other and the remaining sidewalls and being independently movable toward and away from the respective opposite sidewalls; and actuating means operatively connected to said at least one longer sidewall and at least one shorter sidewall for permitting the cross-section of the pocket to be modified between a maximum expansion condition, wherein an orderly group of cigarettes to be packed is introduced into the pocket, and a maximum compression condition, wherein the group of cigarettes received in the pocket is compressed, said actuating means causing one pair of opposite sidewalls to approach each other and thereafter causing the other pair of opposite sidewalls to approach each other, wherein for each pair of opposite sidewalls said actuating means includes a respective cam follower movably mounted in the drum, a respective fixed cam that is co-axial with the drum and that cooperates with the respective cam follower, a respective pair of parallel driving shafts that are rotatably mounted in the drum and that have first and second ends, respective cranks affixed to the first ends of said respective shafts, respective means for operatively connecting the respective cranks to the respective cam follower, respective further cranks affixed to the second ends of the respective shafts, and respective further means for operatively connecting the respective further cranks to at least one of the respective opposite sidewalls.

5. A compression drum according to claim 4, wherein said respective further cranks comprise eccentric pins, and wherein said respective further means comprises an intermediate rib affixed to said at least one of the respective opposite sidewalls, said rib having slots which are rotatably and slidably engaged by said pins.

6. A compression drum according to claim 4, wherein said respective cranks that are attached to the first ends of said shafts comprise crank arms attached to the first ends of spindles attached to the crank arms, and wherein said respective means for operatively connecting the respective cranks to the respective cam follower comprises a respective movable plate attached to the respective cam follower, said respective plate having slots which are slidably and rotatably engaged by said spindles.

7. A compression drum according to claim 4, wherein a longer sidewall and a shorter sidewall are kept stationary in the compression drum.

8. A compression drum according to claim 4, wherein both longer sidewalls and both shorter sidewalls are movably mounted in the compression drum.

* * * * *